US011767689B2

(12) United States Patent
Singh

(10) Patent No.: US 11,767,689 B2
(45) Date of Patent: Sep. 26, 2023

(54) LOCK MECHANISM AND DOOR ASSEMBLY

(71) Applicant: Westinghouse Air Brake Technologies Corporation, Wilmerding, PA (US)

(72) Inventor: Gunneet Singh, Montreal (CA)

(73) Assignee: Westinghouse Air Brake Technologies Corporation, Wilmerding, PA (US)

( * ) Notice: Subject to any disclaimer, the term of this patent is extended or adjusted under 35 U.S.C. 154(b) by 1068 days.

(21) Appl. No.: 16/548,259

(22) Filed: Aug. 22, 2019

(65) Prior Publication Data

US 2019/0376322 A1 Dec. 12, 2019

Related U.S. Application Data

(63) Continuation-in-part of application No. 15/610,005, filed on May 31, 2017, now abandoned.

(51) Int. Cl.

| | |
|---|---|
| ***E05B 81/18*** | (2014.01) |
| ***E05F 15/40*** | (2015.01) |
| ***E05B 81/30*** | (2014.01) |
| ***E05B 81/28*** | (2014.01) |
| ***E05B 81/42*** | (2014.01) |
| ***E05C 1/02*** | (2006.01) |
| ***B61D 19/02*** | (2006.01) |
| ***E05B 81/40*** | (2014.01) |

(Continued)

(52) U.S. Cl.

CPC ..... *E05B 81/18* (2013.01); *E05B 81/28* (2013.01); *E05B 81/30* (2013.01); *E05B 81/42* (2013.01); *E05C 1/02* (2013.01); *E05F 15/40* (2015.01); *B61D 19/02* (2013.01); *E05B 81/40* (2013.01); *E05B 83/04* (2013.01); *E05B 83/363* (2013.01); *E05Y 2900/51* (2013.01)

(58) Field of Classification Search

CPC ..... E05F 15/40; E05F 15/657; E05F 15/565; E05F 15/632; E05F 15/655; E05C 1/02; B61D 19/02; E05B 83/04; E05B 83/363; E05B 83/02; E05B 83/06; E05B 83/40; E05B 81/18; E05B 81/40; E05B 81/90; E05B 15/029; E05B 85/22

USPC ..... 49/141, 366, 367, 370

See application file for complete search history.

(56) References Cited

U.S. PATENT DOCUMENTS

| | | | | |
|---|---|---|---|---|
| 6,446,389 | B1 * | 9/2002 | Heffner | E05F 15/652 49/118 |
| 6,539,669 | B1 * | 4/2003 | Heidrich | B61D 19/008 49/213 |
| 6,739,092 | B2 * | 5/2004 | Heffner | B61D 19/02 49/300 |

FOREIGN PATENT DOCUMENTS

EP 0255991 * 2/1988

* cited by examiner

*Primary Examiner* — Christine M Mills
*Assistant Examiner* — Yahya Sidky
(74) *Attorney, Agent, or Firm* — The Small Patent Law Group LLC; Joseph M. Butscher; Gunneet Singh

(57) ABSTRACT

A lock mechanism is provided for use with a door assembly. The lock mechanism includes a lock bracket configured to connect to a door or hatch; a lock pin can be selectively moved between an engaged position in which the lock pin engages the lock bracket and a disengaged position in which the lock pin does not engage the lock bracket; and a linkage assembly connected to the lock pin and configured to be actuated to reversibly move the lock pin between the engaged position and the disengaged position, and a door or hatch release device can switch the lock pin from the engaged position to the disengaged position if the door or hatch release device is actuated after the linkage assembly has moved the lock pin into the engaged position.

18 Claims, 9 Drawing Sheets

(51) Int. Cl.
*E05B 83/04* (2014.01)
*E05B 83/36* (2014.01)

LOCK MECHANISM AND DOOR ASSEMBLY

CROSS-REFERENCE TO RELATED APPLICATIONS

This application is a continuation-in-part of U.S. patent application Ser. No. 15/610,005, filed May 31, 2017, and the entire disclosure of which is incorporated by reference herein.

BACKGROUND

Technical Field

Embodiments of the subject matter disclosed herein relate to a vehicle door lock.

Discussion of Art

Some lock mechanisms are provided in door systems for transit vehicles to cause the vehicle doors to be locked in a closed position. This may be desirable when, for example, the door system is damaged and/or is undergoing maintenance.

Current standards for public transit vehicles, such as the North American APTA Standard PR-M-S-18-10, require that the emergency release for opening the doors of a transit vehicle also disengages any engaged lock when the release is pulled. The maximum allowable pull force for actuating the emergency release is dictated by applicable standards. It may be desirable to have a system and method that differs from those currently available.

BRIEF DESCRIPTION

In one embodiment, an isolation lock mechanism for a transit vehicle door is provided. The isolation lock includes a lock bracket that can be connected to the transit vehicle door; a lock pin that can be moved between an engaged position in which the lock pin is extended to engage the lock bracket and a disengaged position in which the lock pin is withdrawn from the lock bracket; and a linkage assembly connected to the lock pin and that can be actuated to move the lock pin between the engaged position and the disengaged position. The linkage assembly that can connect to an emergency release device such that operation of the emergency release device actuates the linkage assembly to move the lock pin from the engaged position to the disengaged position. The linkage assembly includes a first arm that can be connected to the emergency release device; a second arm connected to the first arm; a rotating shaft connected to the second arm; a cam fixedly connected to the rotating shaft; and a lever rotatably connected to the cam and the lock pin. The second arm is connected to the first arm such that movement of the first arm due to operation of the emergency release device causes the second arm to rotate about a connection between the second arm and the rotating shaft. This, in turn, causes rotation of the rotating shaft and the cam. Rotation of the cam causes rotation of the lever. Rotation of the lever causes a linear motion of the lock pin between the engaged and disengaged positions.

In one embodiment, a lock mechanism is provided. The lock mechanism includes a lock bracket that can connect to a door or hatch; a lock pin that can be selectively moved between an engaged position in which the lock pin engages the lock bracket and a disengaged position in which the lock pin does not engage the lock bracket; and a linkage assembly connected to the lock pin. The linkage assembly may be actuated to reversibly move the lock pin between the engaged position and the disengaged position. A door or hatch release device can switch the lock pin from the engaged position to the disengaged position if the door or hatch release device is actuated after the linkage assembly has moved the lock pin into the engaged position.

In one embodiment, a door assembly is provided for use with a vehicle having a door opening formed in or defined by a wall of the vehicle. The door assembly includes a door operator system that can move a door along the door opening between open and closed positions. A lock mechanism selectively locks the door. The lock mechanism includes a lock bracket connected to the door, and a lock pin that can be moved between an engaged position in which the lock pin is extended to engage the lock bracket and a disengaged position in which the lock pin is withdrawn from the lock bracket. A release device disengages the lock mechanism of the door operator system and thereby to unlock the door.

BRIEF DESCRIPTION OF THE DRAWINGS

The subject matter described herein includes descriptions of non-limiting embodiments, with reference to the attached drawings, wherein below.

DETAILED DESCRIPTION

Embodiments of the subject matter disclosed herein relate to a lock mechanism, a door assembly, and an emergency release device for a transit vehicle door. The lock mechanism includes a lock bracket that can connect to a door or hatch; a lock pin that can be selectively moved between an engaged position in which the lock pin engages the lock bracket and a disengaged position in which the lock pin does not engage the lock bracket; and a linkage assembly connected to the lock pin. The linkage assembly can be actuated to reversibly move the lock pin between the engaged position and the disengaged position. A door or hatch release device can switch the lock pin from the engaged position to the disengaged position if the door or hatch release device is actuated after the linkage assembly has moved the lock pin into the engaged position.

Figure 1:
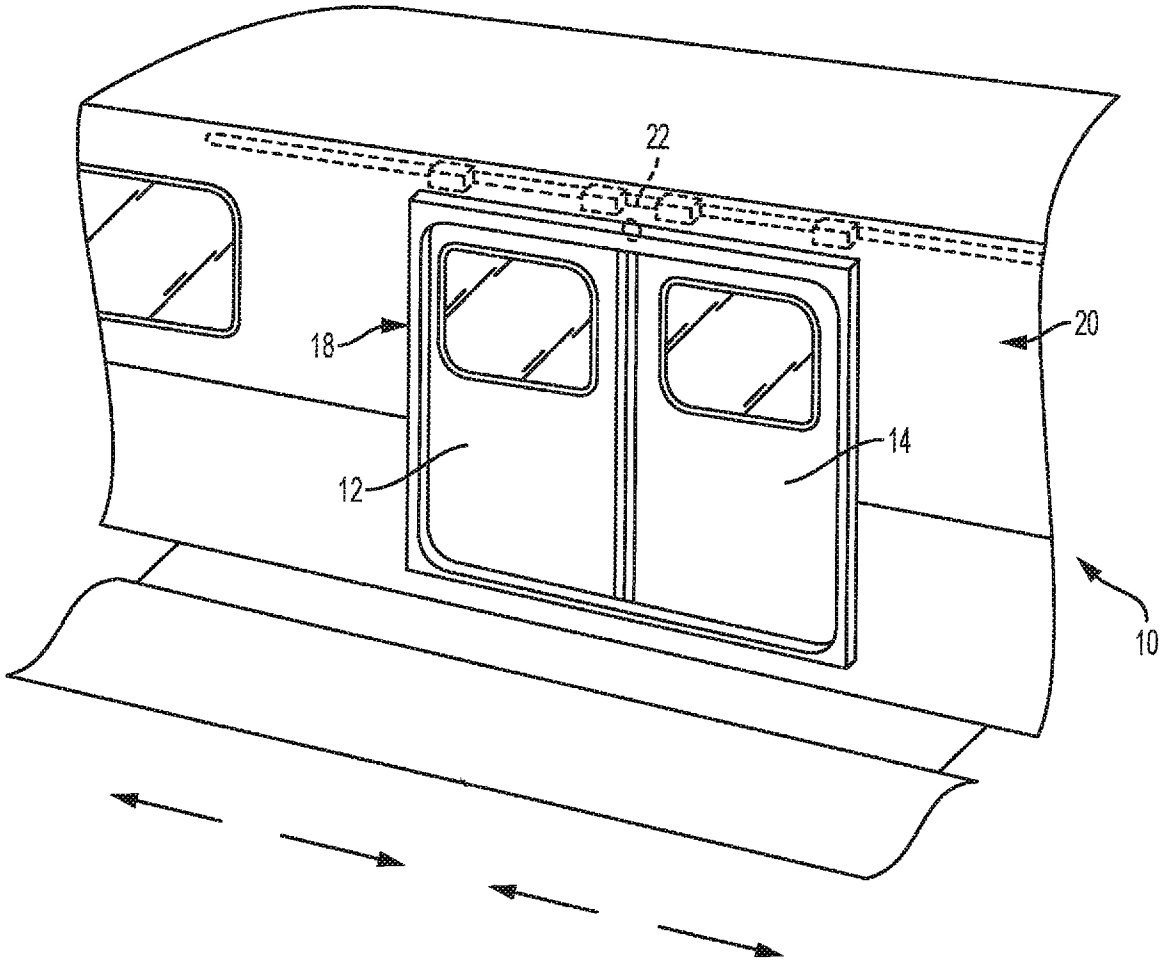
FIG. 1 is a perspective view of a portion of a vehicle having a lock mechanism according to an example of the disclosure.

With reference to FIG. 1, a vehicle 10 is shown according to an example of the disclosure. Suitable vehicles may include transit vehicles (as shown in FIG. 1), such as a subway car, trolley car, or other rail transit vehicle, or other vehicle that interacts with passengers or operators. Suitable other vehicles may include a car, bus, aircraft, mining or construction equipment, and a marine vessel. The vehicle may include a door assembly that may include a pair of outside bi-parting doors 12, 14 and a door operator system 22 according to an example of the disclosure. A suitable door operator system may selectively move one or more doors or door portions to open or close positions. A suitable door operator system may be electric, pneumatic, hydraulic, or manually operated.

As shown, the doors are in a closed position, and the transit vehicle is stopped at a platform. The doors cover a passenger portal or opening 18 formed in or defined by a wall 20 of the transit vehicle. In one embodiment, the doors may be disposed adjacent to the wall and may be slidably suspended from the door operator system. In another embodiment, the doors may be slidably recessed in a wall pocket. In other embodiment, the doors may be a single door that foldably deploys to cover the portal opening. The door operator system itself may be disposed on or in the wall. The location of the door operator may be above the door opening, beside the door opening, or below the door opening depending on application specific requirements. The door operator system may move a pair of doors in opposing directions along the door opening between open and closed positions.

Figure 2:
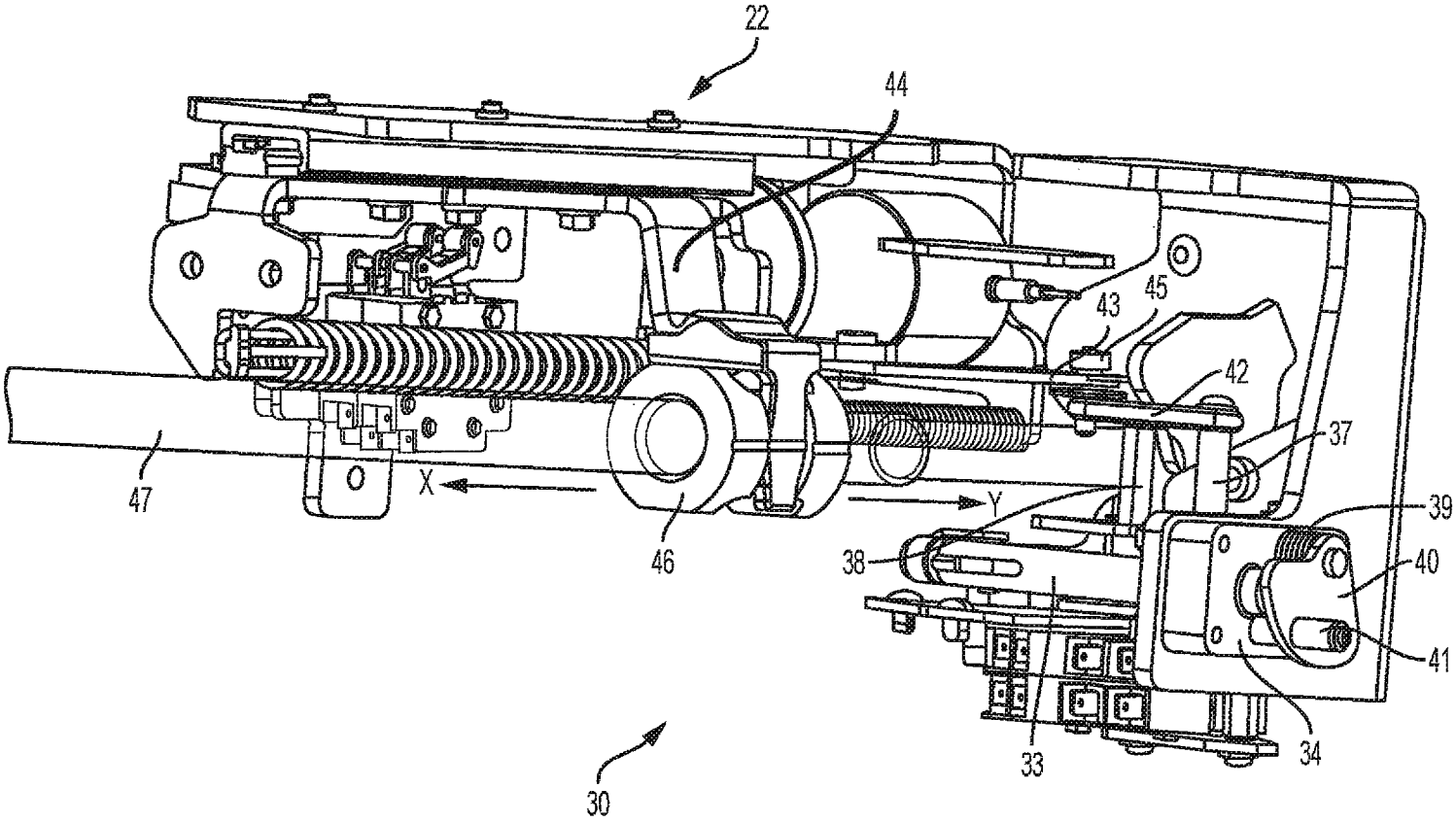
FIG. 2 is a front perspective view of a door operator and a lock mechanism according to an example of the disclosure.
Figure 3:
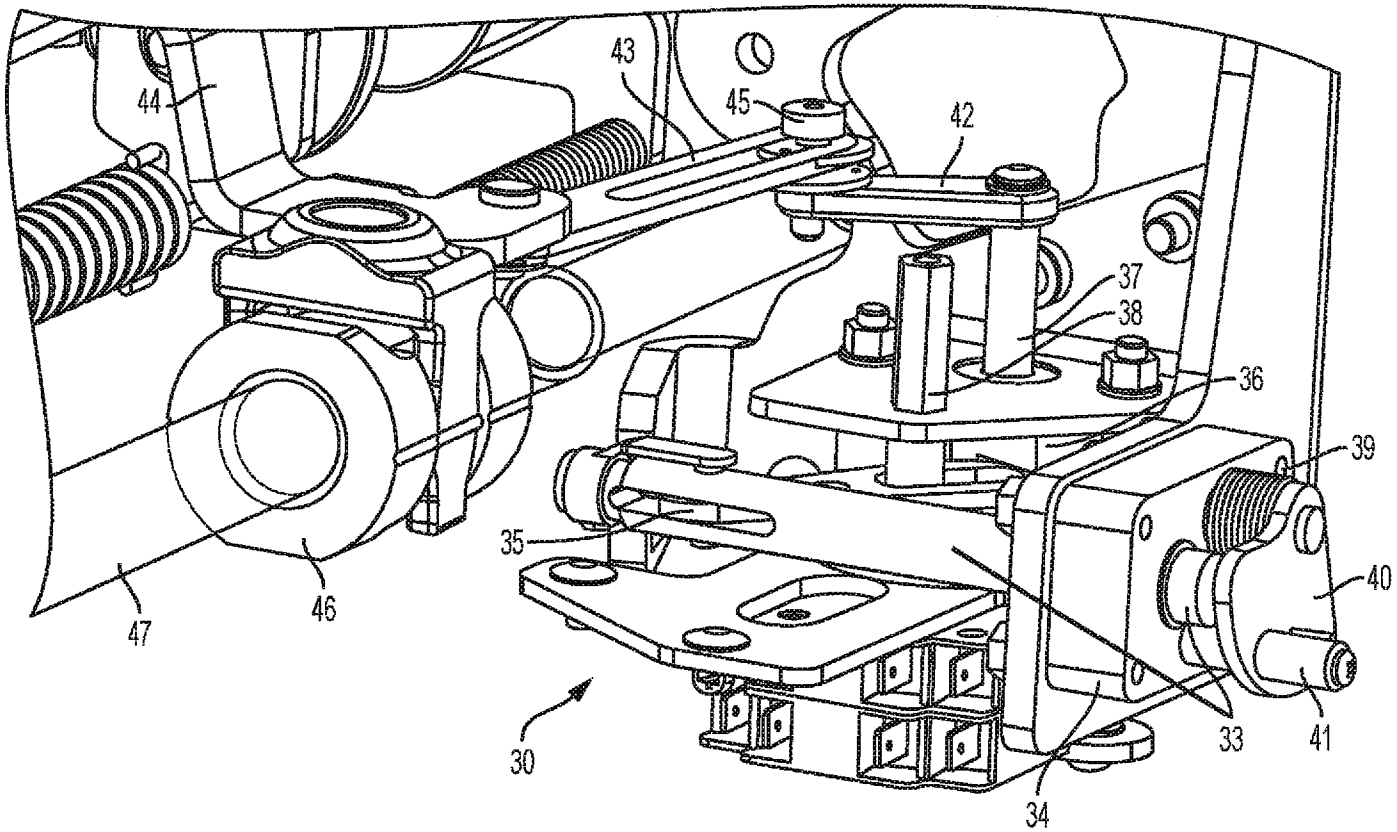
FIG. 3 is an enlarged perspective view of a portion of the lock mechanism of FIG. 2.

As shown in FIGS. 2-9, the door operator system may include a drive nut 46 movable along a drive shaft 47. The drive nut is connected to the door (connection not shown). A mobile carrier 44 and a release cable 48 may define at least part of a release device 50. A suitable release device may be an emergency release device. This release device may be connected to or incorporated into the door operator system. While in the closed and locked position, the drive nut of the door operator system contacts the mobile carrier of the release device. The mobile carrier is movable in the X direction when the release cable of a release device is pulled. With reference to FIGS. 1 and 2, the drive nut is movable along the drive shaft in a first horizontal direction X to unlock the door operator system and to move the door to an open position and in a second horizontal direction Y to lock the door operator system and move the door to a closed position.

Figure 4:
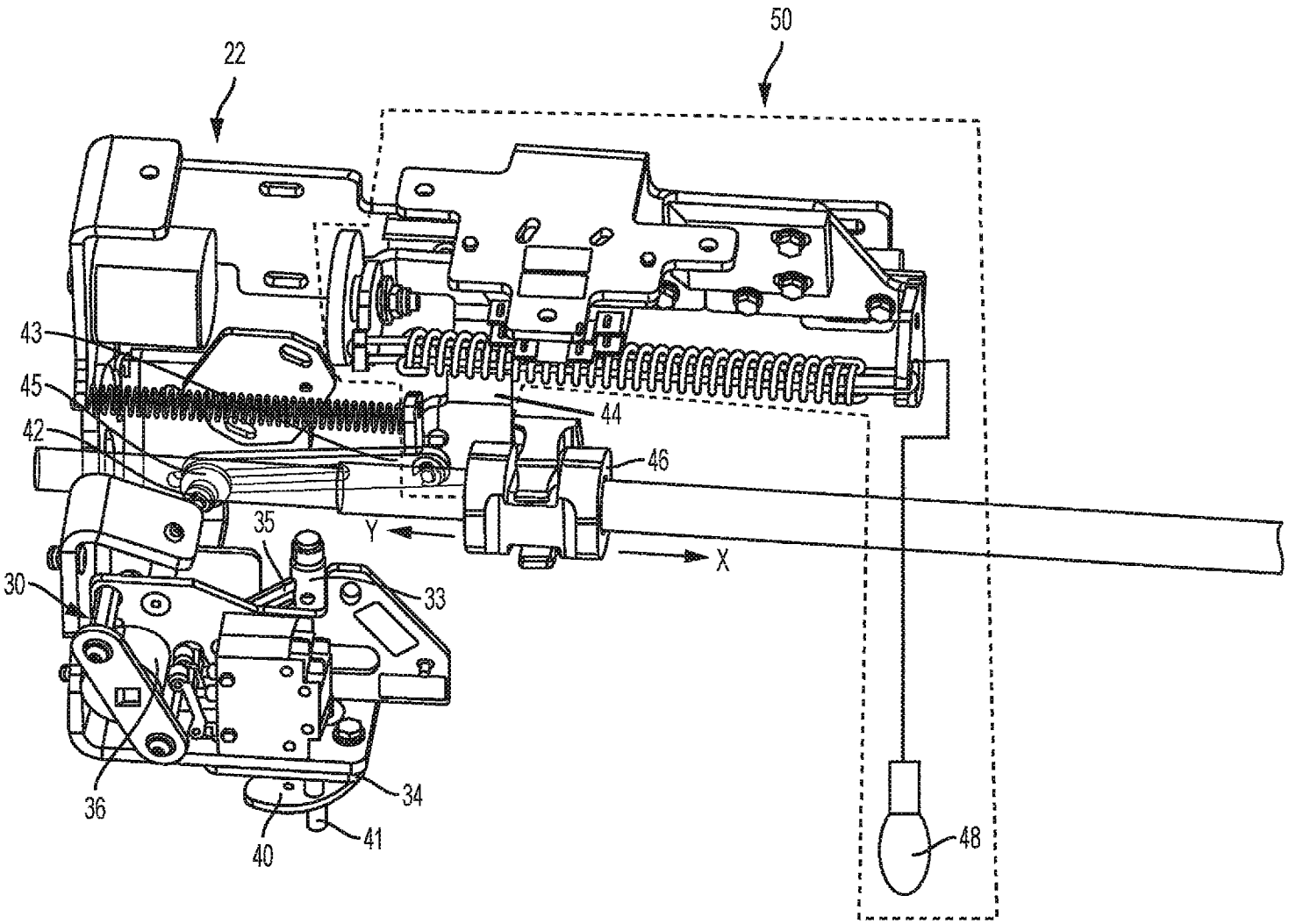
FIG. 4 is a rear perspective view of the lock mechanism of FIG. 2.
Figure 5:
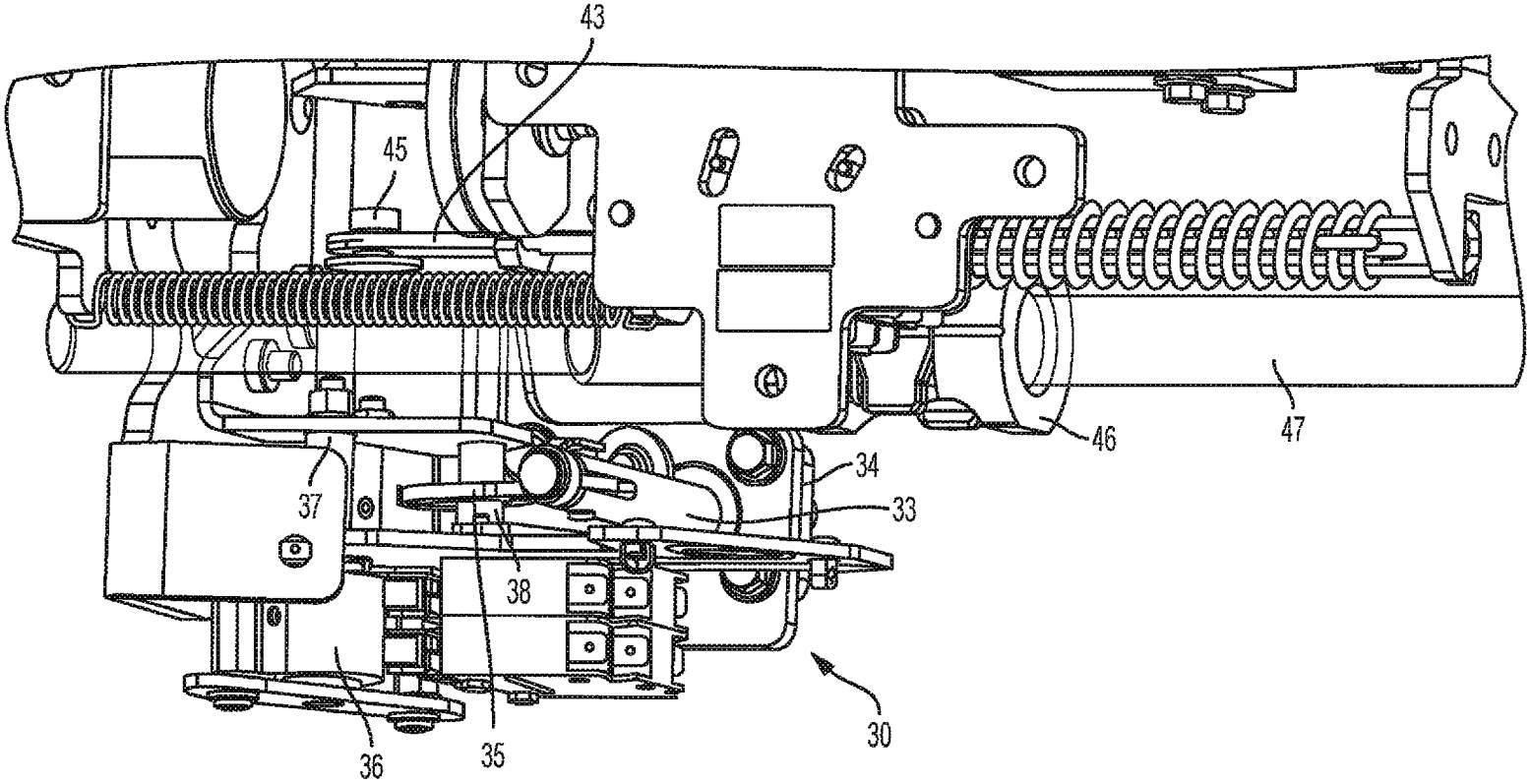
FIG. 5 is an enlarged rear perspective view of a portion of the lock mechanism of FIG. 2.

As shown in FIG. 4, the release device may be manually actuated by pulling on the release cable. Engaging the release cable may cause the mobile carrier to be moved in the X direction. As the mobile carrier moves in the X direction, the mobile carrier contacts and pushes on the drive nut to move along the drive shaft in the X direction. This movement may unlock the overcenter locking mechanism of the door operator system and move the door to the open position.

With reference to FIGS. 2-9, the lock mechanism for the door is shown according to an embodiment. A suitable lock mechanism may be an isolation lock mechanism for an emergency release device. The lock mechanism may include a lock bracket 31 that is connected to the respective door or hatch such that the lock bracket moves horizontally when the door moves between the open and closed positions. The lock bracket may include a mortise hole 32 defined therein.

Figure 6:
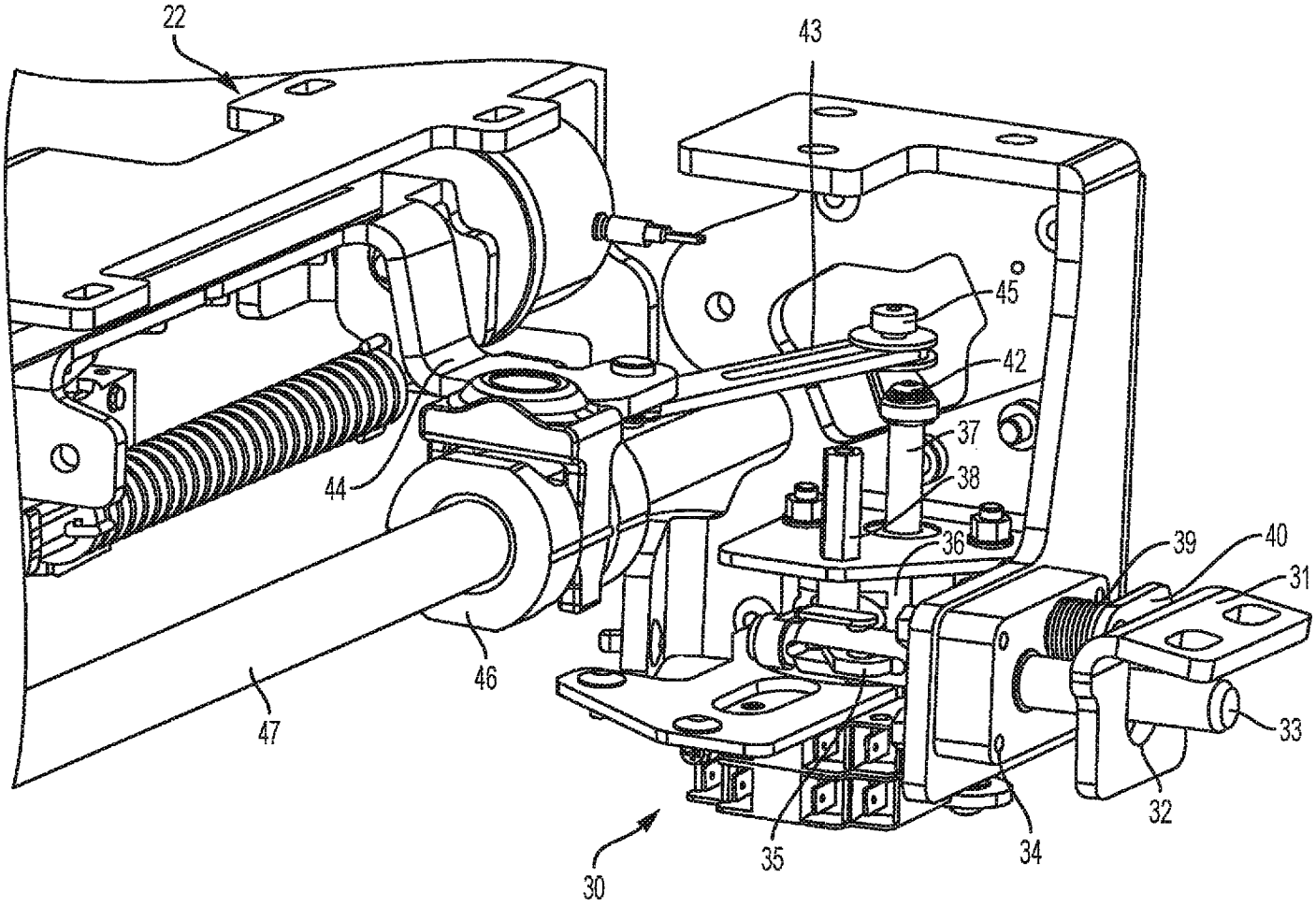
FIG. 6 is an enlarged perspective view of a portion of the lock mechanism of FIG. 2 in an engaged position.
Figure 7:
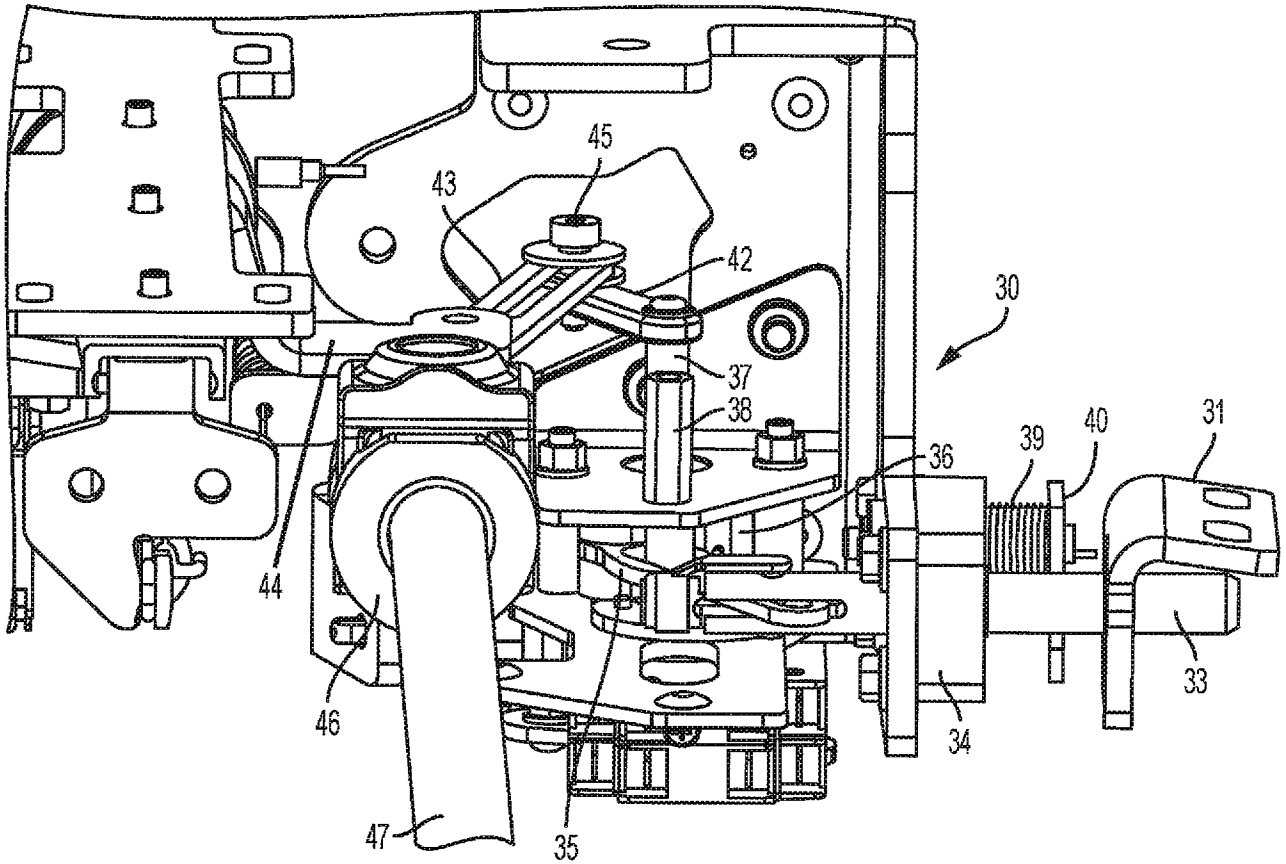
FIG. 7 is another enlarged perspective view of a portion of the lock mechanism of FIG. 2 in an engaged position.

The lock mechanism may include a lock pin 33 that can be selectively moved between an engaged position, shown in FIGS. 6 and 7, in which the lock pin is extended to engage the lock bracket, particularly within the mortise hole, and a disengaged position, shown in FIGS. 2-5, 8, and 9, in which the lock pin is withdrawn from the lock bracket. The lock bracket may be positioned on the door such that the mortise hole of the lock bracket is positioned concentric with the lock pin when the door is in the closed position. In the engaged position, the lock pin extends to engage the lock bracket, thereby preventing the door from opening. In the disengaged position, the lock pin is withdrawn from the lock bracket so that the door is free to move with operation of the door operator system.

As shown in FIGS. 2-9, the lock pin is supported for linear movement between the engaged and disengaged positions by a journal bearing 34 attached to the structure of the door operator system. A linkage assembly 30, including components 35, 36, 37, 38, 42, 43, 45, is connected to the lock pin and is actuated to move the lock pin between the engaged position and the disengaged position. The linkage assembly connects to the release device such that operation of the release device to unlock the door concurrently actuates the linkage assembly to move the lock pin from the engaged position to the disengaged position if the linkage assembly is in the activated state, as will be discussed below.

The linkage assembly may include a slotted first arm 43 connected to the release device. The slotted first arm is directly connected to the mobile carrier of the release device. The linkage assembly further may include a second arm 42 connected to the first arm by a linkage fastener 45 that engages the first arm along the slot such that the linkage fastener, and thus the end of the second arm, is able to slide with respect to the slotted first arm. The opposite end of the second arm connects to a rotating shaft 37 that is rotatably supported on the structure of the lock mechanism. A cam 36 is fixedly connected to the rotating shaft so as to rotate with the rotating shaft along the axis of the rotating shaft. A lever 35 is rotatably connected to the cam 36 concentric to the axis of the rotating shaft. The lever is also rotatably connected to an end of the lock pin. A fixed shaft 38 is fixed to the structure of the lock mechanism and engages the central portion of the lever to guide rotation of the lever.

The second arm is connected to the slotted first arm such that movement of the first arm caused by linear movement of the mobile carrier during operation of the release device causes the second arm to rotate about a connection between the second arm and the rotating shaft, which in turn causes rotation of the rotating shaft and the cam. The rotation of the cam causes rotation of the lever about the fixed shaft. Rotation of the lever causes a linear motion of the lock pin between the engaged and disengaged positions.

Figure 8:
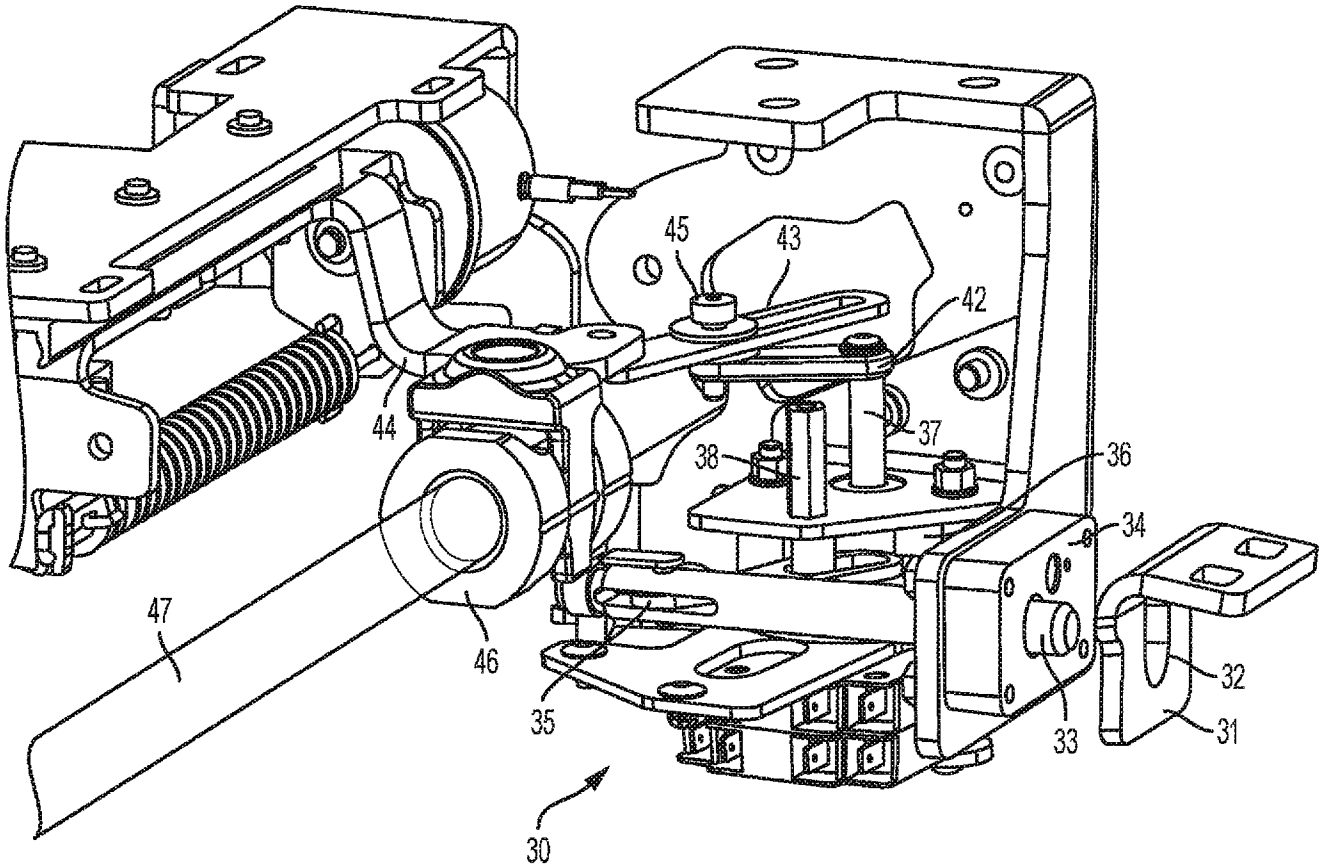
FIG. 8 is an enlarged perspective view of a portion of the lock mechanism of FIG. 2 in a deactivated state.
Figure 9:
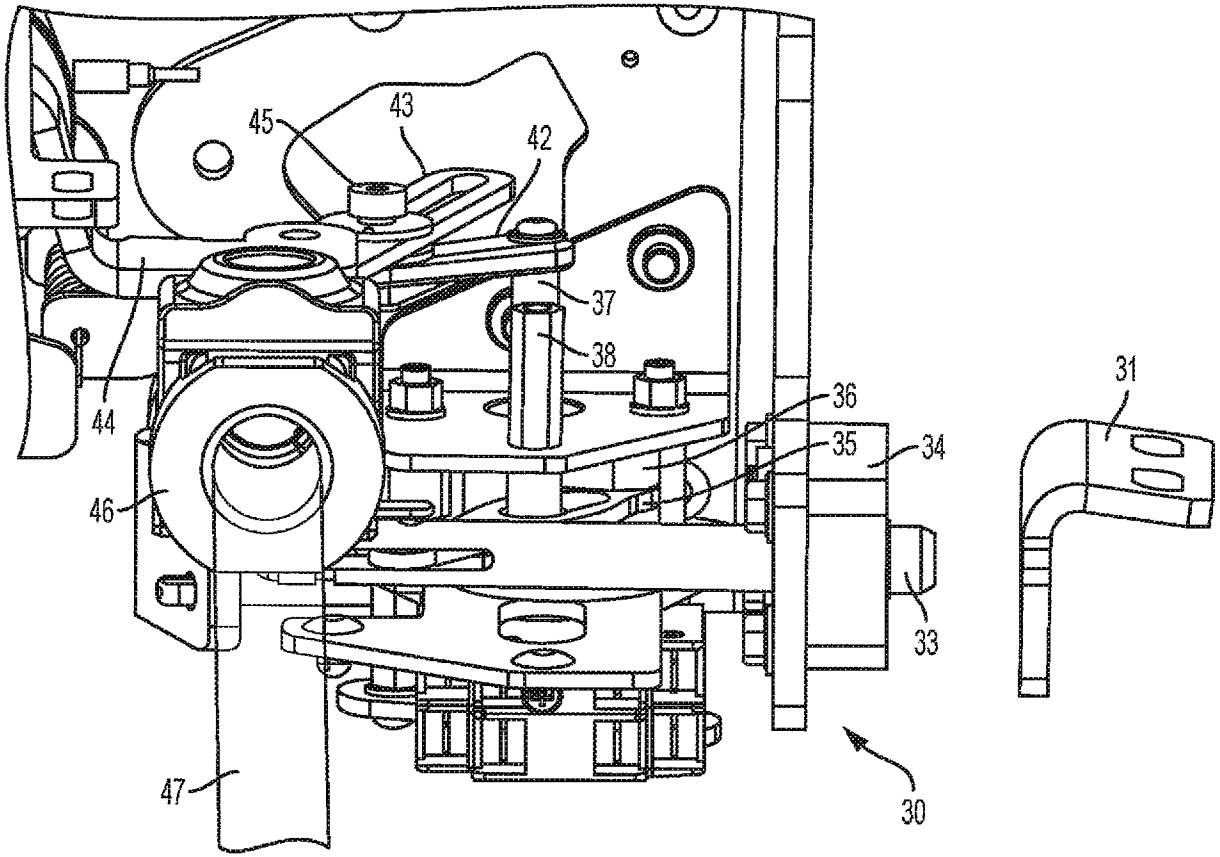
FIG. 9 is another enlarged perspective view of a portion of the door operator system and lock mechanism of FIG. 2 in a deactivated state.

The rotating shaft can be manually rotated by maintenance personnel using a crew key or similar device. Manual rotation of the rotating shaft causes the second arm and the linkage fastener connecting the second arm to the slotted first arm to move with respect to the first arm such that the linkage fastener slides along the slot defined in the first arm. Accordingly, the linkage assembly can be switched between an activated state, in which the linkage fastener engages an end of the slot on the first arm, as shown in FIGS. 2-7, such that operation of the release device actuates the linkage assembly to move the lock pin between the engaged and disengaged positions, and a deactivated state, in which the linkage fastener engages the slot of the first arm away from the end, as shown in FIGS. 8 and 9, such that operation of the release device does not actuate the linkage assembly to move the lock pin.

As shown in FIGS. 2-4, 6, and 7, the journal bearing, which linearly supports the lock pin, may include a pivot shaft 39 that rotatably connects a mask plate 40 to the journal bearing. In one embodiment, the mask plate may pivot on the pivot shaft between a blocking position, shown in FIGS. 2-4, in which the mask plate is disposed in a linear path of the lock pin to prevent the lock pin from moving to the engaged position, and a releasing position, shown in FIGS. 6 and 7, in which the mask plate is disposed away from the linear path of the lock pin to allow the lock pin to move to the engaged position. According to one example, the pivot shaft is sized and shaped such that the mask plate is able to pivot about the pivot shaft approximately 90°. The pivot shaft may be spring-loaded such that the mask plate is biased toward the blocking position. The mask plate may include a bumper pin 41 that is engaged by an edge of the lock bracket as the door enters the closed position such that the mask plate is moved to the releasing position by the lock bracket, as shown in FIGS. 6 and 7.

With reference to FIGS. 2-5, the lock mechanism and the release device are shown when the door is in the open position either during normal operation or because the emergency pull cable has been manually actuated to pull the door open. The mobile carrier and the drive nut are advanced in the direction X thereby moving the slotted first arm, which may be directly connected to the mobile carrier, in the same direction with respect to the linkage fastener and the end of the second arm with the linkage fastener engaging an end of the slot of the first arm away from the mobile carrier. The linkage assembly is situated such that the lock pin has been moved to the disengaged position. The mask plate may be disposed in the blocking position to prevent the lock pin from being inadvertently moved to the engaged position while the door is still open.

With reference to FIGS. 6 and 7, the lock mechanism and the door operator system are shown when the door is in the closed position and the linkage assembly is in the activated state. The condition of the lock mechanism illustrated in FIGS. 6 and 7 must be manually selected by rotating the rotating shaft with a tool, such as a crew key, when the door is placed out of service during maintenance or repair. The rotating shaft has been rotated such that the linkage fastener and the end of the second arm engage the end of the slot in the first arm opposite to the mobile carrier and such that the lever has been rotated in a counterclockwise (viewed from the top) direction to linearly extend the lock pin to the engaged position in which the lock pin engages the mortise hole defined in the lock bracket to lock the door in the closed position. The lock bracket has engaged the bumper pin 41 on the mask plate to move the mask plate to the releasing position, thereby freeing the lock pin to enter the engaged position.

When the linkage assembly is in the activated state, as shown, actuation of the emergency release cable causes movement of the mobile carrier and the drive nut along the drive shaft in the opening direction X, parallel to the plane of movement of the door to the open position. The movement of the mobile carrier in this direction pulls on the slotted first arm, which in turn causes rotation of the second arm, the rotation shaft, and the cam, which causes the lever to rotate clockwise (viewed from the top) about the fixed shaft to move the lock pin from the engaged position to the disengaged position.

Accordingly, actuation of the emergency release device to open the door via the emergency release cable when the linkage assembly is in the activated state will cause the linkage assembly to move the lock pin to the disengaged position. In one embodiment, the door operator system incorporates an overcenter locking mechanism. The actuation of the release device to open the door may cause linear motion of the mobile carrier, which, in turn, will push on the drive nut of the door operator system to move in the X direction, to move the drive nut to an unlocked position. A short distance of linear travel of the drive nut, such as a few centimeters, is required to unlock the overcenter locking mechanism. The lock mechanism may be arranged and connected to the release device in a manner that is synchronized with the overcenter locking mechanism of the door operator system such that the motion of the mobile carrier to cause the drive nut to unlock the overcenter locking mechanism also causes the lock mechanism to move the lock pin to the disengaged position, freeing the door to be moved to the open position. The lock mechanism may be used in conjunction with any door operator system having a different overcenter locking mechanism or with no overcenter locking mechanism.

With reference to FIGS. 8 and 9, the lock mechanism and the door operator system are shown when the door is in the closed position and the linkage assembly is in the deactivated state. The rotatable shaft has been manually rotated such that the linkage fastener and the end of the second arm engage the slot of the first arm proximate to the end of the first arm where the first arm engages the mobile carrier and opposite to the end of the slot of the first arm engaged by the linkage fastener and the end of the second arm when the linkage assembly is in the activated state shown in FIGS. 6 and 7. The mask plate is in the blocking position illustrated in FIGS. 2-4. In this position, linear movement of the mobile carrier and the drive nut in the X direction due to operation of the emergency release device through manual actuation of the emergency pull cable, will pull on the first arm. The linkage fastener and the end of the second arm will stay at rest causing the first arm to slide with respect to the linkage fastener and the second arm in engagement with the slot of the first arm. Accordingly, the second arm will not be rotated by the movement of the first arm and the lock pin remains in the disengaged position.

Reference is made in detail to various embodiments of the inventive subject matter, examples of which are illustrated in the accompanying drawings. The same reference numerals used throughout the drawings may refer to the same or like parts. As disclosed below, multiple version of a same element may be disclosed. Likewise, with respect to other elements, a singular version may be is disclosed. Neither multiple versions disclosed nor a singular version disclosed shall be considered limiting. Specifically, although multiple versions are disclosed, a singular version may be utilized. Likewise, where a singular version is disclosed, multiple versions may be utilized. The description is illustrative and not restrictive. In addition, many modifications may be made to adapt a particular situation or material to the teachings of the inventive subject matter without departing from its scope. While the dimensions and types of materials described herein are intended to define the parameters of the inventive subject matter, they are by no means limiting and are exemplary embodiments. Other embodiments may be apparent to one of ordinary skill in the art upon reviewing the above description. The scope of the inventive subject matter should, therefore, be determined with reference to the appended claims, along with the full scope of equivalents to which such claims are entitled.

In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure. And, as used herein, an element or step recited in the singular and proceeded with the word "a" or "an" should be understood as not excluding plural of said elements or steps, unless such exclusion is explicitly stated. Furthermore, references to "one embodiment" of the inventive subject matter are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

This written description uses examples to disclose several embodiments of the inventive subject matter and also to enable a person of ordinary skill in the art to practice the embodiments of the inventive subject matter, including making and using any devices or systems and performing any incorporated methods. The patentable scope of the inventive subject matter is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

What is claimed is:

1. A lock mechanism, comprising:

a lock bracket configured to connect to a door or hatch;

a lock pin configured to be linearly moved between an engaged position in which the lock pin engages the lock bracket, and a disengaged position in which the lock pin does not engage the lock bracket;

a linkage assembly connected to the lock pin and configured to be actuated to reversibly move the lock pin between the engaged position and the disengaged position;

a release device configured to switch the lock pin from the engaged position to the disengaged position if the release device is actuated after the linkage assembly has moved the lock pin into the engaged position, wherein the linkage assembly is configured to be switched between an activated state in which operation of the release device actuates the linkage assembly, and a deactivated state in which operation of the release device does not actuate the linkage assembly; and a mask plate and a pivot shaft rotatably connecting the mask plate to a journal bearing, wherein the mask plate is pivotable on the pivot shaft between a blocking position in which the mask plate is disposed in a linear path of the lock pin to prevent the lock pin from moving to the engaged position, and a releasing position in which the mask plate is disposed away from the linear path of the lock pin.

2. The lock mechanism according to claim 1, further comprising a door operator system configured to move the door or hatch relative to a vehicle opening or portal in one or more of:

from an open position to a closed position, and thereby to close the vehicle opening or portal, from the closed position to the open position, and thereby to open the vehicle opening or portal, from the closed position or the open position to an intermediate position, and thereby to partially open or partially close the vehicle opening or portal, or to selectively lock the door or hatch, wherein actuation of the release device unlocks the door operator system.

3. The lock mechanism according to claim 1, wherein the mask plate is biased toward the blocking position.

4. The lock mechanism according to claim 1, wherein the mask plate comprises a bumper pin configured to be engaged by the lock bracket such that the mask plate is moved to the releasing position by the lock bracket as the door or hatch closes.

5. The lock mechanism according to claim 1, wherein the linkage assembly comprises:

a first arm configured to be connected to the release device;

a second arm connected to the first arm;

a rotating shaft connected to the second arm;

a cam fixedly connected to the rotating shaft; and a lever rotatably connected to the cam and the lock pin, wherein the second arm is connected to the first arm such that movement of the first arm due to operation of the release device causes the second arm to rotate about a connection between the second arm and the rotating shaft, which causes rotation of the rotating shaft and the cam, rotation of the cam causes rotation of the lever, and rotation of the lever moves the lock pin linearly between the engaged position and the disengaged position.

6. The lock mechanism according to claim 5, wherein the linkage assembly further comprises a fixed shaft, wherein the fixed shaft engages the lever to guide the rotation of the lever.

7. The lock mechanism according to claim 5, wherein the first arm is slotted and is connected to the second arm by a linkage fastener configured to slide with respect to the first arm.

8. The lock mechanism according to claim 7, wherein the linkage assembly is configured to be switched between an activated state in which the linkage fastener engages an end of the first arm such that operation of the release device actuates the linkage assembly, and a deactivated state in which the linkage fastener engages the first arm away from the end such that operation of the release device does not actuate the linkage assembly.

9. A door assembly for a vehicle having a door opening formed in or defined by a wall of the vehicle, the door assembly comprising:

a door operator system configured to move at least one door along the door opening between open and closed positions;

a lock mechanism configured to selectively lock the at least one door, the lock mechanism comprising:

a lock bracket connected to the door;

a lock pin configured to be linearly moved between an engaged position in which the lock pin is extended to engage the lock bracket, and a disengaged position in which the lock pin is withdrawn from the lock bracket;

a journal bearing that supports linear motion of the lock pin between the engaged position and the disengaged position;

a linkage assembly connected to the lock pin and configured to be actuated to reversibly move the lock pin between the engaged position and the disengaged position; and a release device configured to disengage the lock mechanism and thereby to unlock the at least one door.

10. The door assembly according to claim 9, wherein the linkage assembly is configured to switch between an activated state in which operation of the release device actuates the linkage assembly, and a deactivated state in which operation of the release device does not actuate the linkage assembly.

11. The door assembly according to claim 9, wherein the lock mechanism further comprises a mask plate and a pivot shaft rotatably connecting the mask plate to the journal bearing, wherein the mask plate is pivotable on the pivot shaft between a blocking position in which the mask plate is disposed in a linear path of the lock pin to prevent the lock pin from moving to the disengaged position, and a releasing position in which the mask plate is disposed away from the linear path of the lock pin.

12. The door assembly according to claim 9, wherein the linkage assembly comprises:

a first arm connected to the release device;

a second arm connected to the first arm;

a rotating shaft connected to the second arm;

a cam fixedly connected to the rotating shaft; and a lever rotatably connected to the cam and the lock pin, wherein the second arm is connected to the first arm such that movement of the first arm due to operation of the release device causes the second arm to rotate about a connection between the second arm and the rotating shaft, which causes rotation of the rotating shaft and the cam, wherein rotation of the cam causes rotation of the lever, and wherein rotation of the lever causes linear motion of the lock pin between the engaged position and the disengaged position.

13. The door assembly according to claim 12, wherein the first arm is slotted and is connected to the second arm by a linkage fastener configured to slide with respect to the first arm, wherein the linkage assembly is configured to be switched between an activated state in which the linkage fastener engages an end of the first arm such that operation of the release device actuates the linkage assembly, and a deactivated state in which the linkage fastener engages the first arm away from the end such that operation of the release device does not actuate the linkage assembly.

14. The door assembly according to claim 13, wherein actuation of the release device to unlock the door operator system simultaneously actuates the lock mechanism to move the lock pin to the disengaged position.

15. An isolation lock mechanism for a transit vehicle door, the isolation lock mechanism comprising:

a lock bracket configured to be connected to the transit vehicle door;

a lock pin configured to be linearly moved between an engaged position in which the lock pin is extended to engage the lock bracket, and a disengaged position in which the lock pin is withdrawn from the lock bracket;

a journal bearing that supports linear motion of the lock pin between the engaged position and the disengaged position; and a linkage assembly connected to the lock pin and configured to be actuated to move the lock pin between the engaged position and the disengaged position, wherein the linkage assembly is configured to be connected to a release device such that operation of the release device actuates the linkage assembly to move the lock pin from the engaged position to the disengaged position, wherein the linkage assembly comprises:

a first arm configured to be connected to the release device;

a second arm connected to the first arm;

a rotating shaft connected to the second arm;

a cam fixedly connected to the rotating shaft; and a lever rotatably connected to the cam and the lock pin, wherein the second arm is connected to the first arm such that movement of the first arm due to operation of the release device causes the second arm to rotate about a connection between the second arm and the rotating shaft, which causes rotation of the rotating shaft and the cam, wherein rotation of the cam causes rotation of the lever, and rotation of the lever causes linear motion of the lock pin between the engaged and disengaged positions.

16. The isolation lock mechanism according to claim 15, further comprising a mask plate and a pivot shaft rotatably connecting the mask plate to the journal bearing, wherein the mask plate is pivotable on the pivot shaft between a blocking position in which the mask plate is disposed in a linear path of the lock pin to prevent the lock pin from moving to the engaged position, and a releasing position in which the mask plate is disposed away from the linear path of the lock pin.

17. A lock mechanism, comprising:

a lock bracket configured to connect to a door or hatch;

a lock pin configured to be linearly moved between an engaged position in which the lock pin engages the lock bracket, and a disengaged position in which the lock pin does not engage the lock bracket;

a linkage assembly connected to the lock pin and configured to be actuated to reversibly move the lock pin between the engaged position and the disengaged position;

a release device configured to switch the lock pin from the engaged position to the disengaged position if the release device is actuated after the linkage assembly has moved the lock pin into the engaged position, wherein the linkage assembly comprises:

a first arm configured to be connected to the release device;

a second arm connected to the first arm, wherein the first arm is slotted and is connected to the second arm by a linkage fastener configured to slide with respect to the first arm;

a rotating shaft connected to the second arm;

a cam fixedly connected to the rotating shaft; and a lever rotatably connected to the cam and the lock pin, wherein the second arm is connected to the first arm such that movement of the first arm due to operation of the release device causes the second arm to rotate about a connection between the second arm and the rotating shaft, which causes rotation of the rotating shaft and the cam, rotation of the cam causes rotation of the lever, and rotation of the lever moves the lock pin linearly between the engaged position and the disengaged position.

18. The lock mechanism according to claim 17, wherein the linkage assembly is configured to be switched between an activated state in which the linkage fastener engages an end of the first arm such that operation of the release device actuates the linkage assembly, and a deactivated state in which the linkage fastener engages the first arm away from the end such that operation of the release device does not actuate the linkage assembly.

* * * * *